US007059423B1

(12) United States Patent
Hoggarth

(10) Patent No.: US 7,059,423 B1
(45) Date of Patent: Jun. 13, 2006

(54) JACKHAMMER SYSTEM

(76) Inventor: DeVerne Hoggarth, 951 2nd Ave., NW., Valley City, ND (US) 58072

( * ) Notice: Subject to any disclaimer, the term of this patent is extended or adjusted under 35 U.S.C. 154(b) by 0 days.

(21) Appl. No.: 10/854,472

(22) Filed: May 26, 2004

(51) Int. Cl.
*E21B 7/24* (2006.01)

(52) U.S. Cl. ..... 173/49; 173/53; 173/90; 173/114; 173/121; 173/211; 227/147

(58) Field of Classification Search ..... 173/49, 173/53, 90, 114, 121, 210, 211; 227/2, 147
See application file for complete search history.

(56) References Cited

U.S. PATENT DOCUMENTS 3,559,753 A * 2/1971 Meri et al. ..... 173/137
4,042,036 A * 8/1977 Smith et al. ..... 173/13
4,060,138 A * 11/1977 Cox et al. ..... 173/49
4,077,303 A * 3/1978 Poulsen ..... 91/50
4,237,987 A * 12/1980 Sherman ..... 173/117
4,747,455 A 5/1988 Cunningham ..... 173/1
4,964,558 A * 10/1990 Crutcher et al. ..... 227/8
5,174,386 A * 12/1992 Crover ..... 173/53
5,797,463 A * 8/1998 Winter et al. ..... 173/211
6,488,264 B1 * 12/2002 Wiklund ..... 251/218
2004/0159450 A1 * 8/2004 Campling ..... 173/128

OTHER PUBLICATIONS

Buster 'B' brochure JDB Corporation.

* cited by examiner

*Primary Examiner*—Scott A. Smith
*Assistant Examiner*—Gloria R. Weeks

(57) ABSTRACT

A jackhammer system for reducing the vibration and noise experienced by an operator of the jackhammer. The jackhammer system includes a housing, a chisel movably positioned within a lower neck of the housing, a pair of flywheels rotatably attached to a pair of support brackets, a ram slidably positioned within a guide channel and engageable by the flywheels to engage the chisel, a plurality of elastic members attached to the ram, and an actuator mechanically connected to the support brackets for controlling a position of the flywheels. An upper sensor and a lower sensor determine the position of the ram within the guide channel. An engaging plate supported by a plurality of compression springs receives the downwardly impact of the ram when driving the chisel downwardly. A recoil absorber having a recoil spring is attached to an upper portion of the housing for absorbing the recoil of the ram.

18 Claims, 7 Drawing Sheets

JACKHAMMER SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to jackhammers and more specifically it relates to a jackhammer system that has reduced vibration for the operator.

2. Description of the Related Art

Jackhammers have been in use for years and are utilized to break up concrete, asphalt and other hard material. A conventional jackhammer is powered by compressed air and emits a significant amount of vibration to the operator. This continued vibration can result in fatigue and possible injury to the operator of the jackhammer. Hence, there is a need for a jackhammer that has a significantly reduced vibration for the operator.

BRIEF SUMMARY OF THE INVENTION

In view of the foregoing disadvantages inherent in the known types of jackhammers now present in the prior art, the present invention provides a new jackhammer system construction wherein the same can be utilized for reducing the vibration and sound to an operator.

The general purpose of the present invention, which will be described subsequently in greater detail, is to provide a new jackhammer system that has many of the advantages of the jackhammers mentioned heretofore and many novel features that result in a new jackhammer system which is not anticipated, rendered obvious, suggested, or even implied by any of the prior art jackhammers, either alone or in any combination thereof.

To attain this, the present invention generally comprises a housing, a chisel movably positioned within a lower neck of the housing, a pair of flywheels rotatably attached to a pair of support brackets, a ram slidably positioned within a guide channel and engageable by the flywheels to engage the chisel, a plurality of elastic members attached to the ram, and an actuator mechanically connected to the support brackets for controlling a position of the flywheels. An upper sensor and a lower sensor determine the position of the ram within the guide channel. An engaging plate supported by a plurality of compression springs receives the downwardly impact of the ram when driving the chisel downwardly. A recoil absorber having a recoil spring is attached to an upper portion of the housing for absorbing the recoil of the ram.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a jackhammer system that will overcome the shortcomings of the prior art devices.

A second object is to provide a jackhammer system for reducing the vibration and noise experienced by a jackhammer operator.

Another object is to provide a jackhammer system that reduces fatigue and the potential for injury to a jackhammer operator.

An additional object is to provide a jackhammer system that is easy to handle.

A further object is to provide a jackhammer system that allows a jackhammer operator to work an increased period of time.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
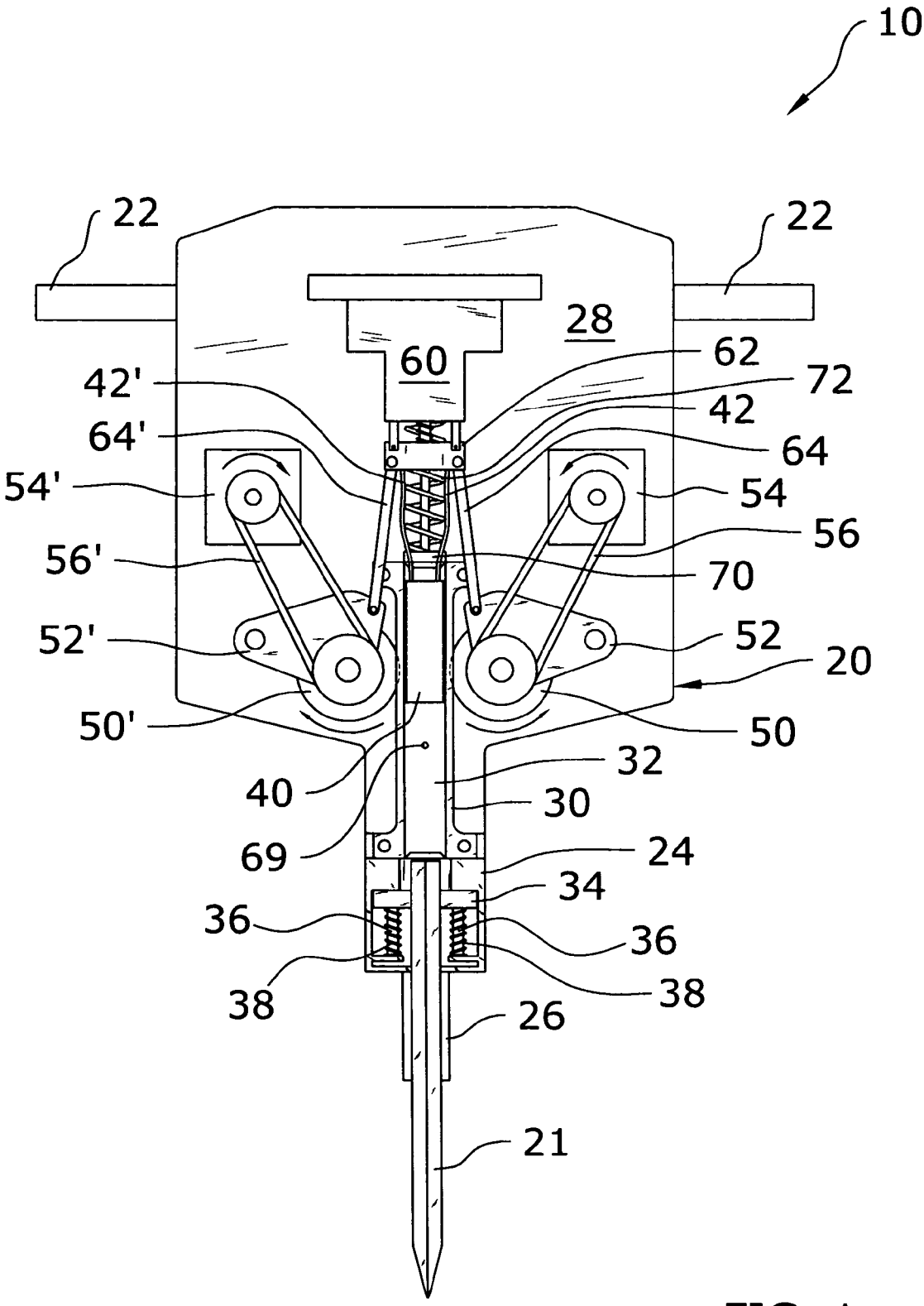
FIG. 1 is a side view of the present invention.

Turning now descriptively to the drawings, in which similar reference characters denote similar elements throughout the several views, FIGS. 1 through 7 illustrate a jackhammer system 10, which comprises a housing 20, a chisel 21 movably positioned within a lower neck 26 of the housing 20, a pair of flywheels 50 rotatably attached to a pair of support brackets 52, a ram 40 slidably positioned within a guide channel 32 and engageable by the flywheels 50 to engage the chisel 21, a plurality of elastic members 42 attached to the ram 40, and an actuator 60 mechanically connected to the support brackets 52 for controlling a position of the flywheels 50. An upper sensor 68 and a lower sensor 69 determine the position of the ram 40 within the guide channel 32. An engaging plate 34 supported by a plurality of compression springs 38 receives the downwardly impact of the ram 40 when driving the chisel 21 downwardly. A recoil absorber 70 having a recoil spring 72 is attached to an upper portion 28 of the housing 20 for absorbing the recoil of the ram 40.

B. Housing

Figure 2:
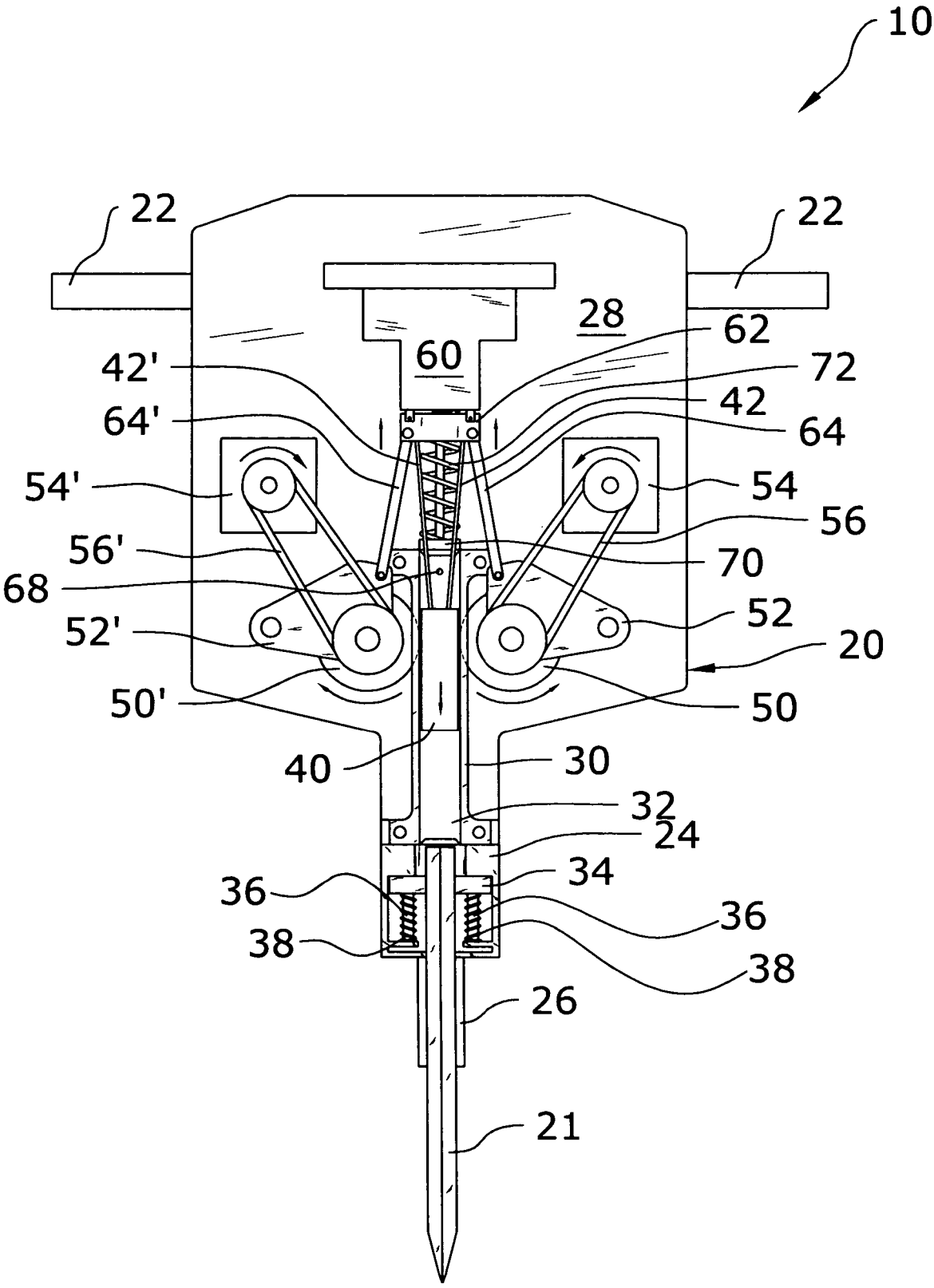
FIG. 2 is a side view of the present invention with the ram being engaged by the flywheels.

An exemplary housing 20 is shown in FIGS. 1 and 2 of the drawings. The housing 20 may be comprised of various structures capable of supporting the components discussed below. The housing 20 may also have a general structure and configuration generally utilized for conventional jackhammers. One or more handles 22 are preferably attached to the housing for the operator to grasp along with a trigger mechanism connected to the control unit 66 for allowing control over the present invention.

The housing 20 generally has an interior portion for storing the working components of the present invention. The housing 20 preferably has a lower neck 26 that slidably supports the chisel 21 as shown in FIGS. 1 through 6 of the drawings. The chisel 21 may be comprised of various tools commonly utilized upon jackhammers and similar devices.

C. Ram

A ram 40 is slidably positioned within a guide channel 32 of a guide member 30 as shown in FIGS. 1 through 6 of the drawings. The guide member 30 is attached to the housing 20 as illustrated in FIGS. 1 through 6 of the drawings. The guide channel 32 is aligned with the chisel 21 as further shown in FIGS. 1 through 6 of the drawings.

The ram 40 may have various cross sectional shapes such as but not limited to circular, square, oval and rectangular. The ram 40 preferably has an elongated structure as shown in FIGS. 1 through 6 of the drawings. The ram 40 is also preferably comprised of a heavy material such as metal capable of impacting the chisel 21 and causing the chisel 21 to penetrate a hard surface such as but not limited to concrete 12. The weight of the ram 40 is chosen based upon the amount of force and impact desired upon the chisel 21.

One or more elastic members 42 are preferably attached to the ram 40 and to the housing 20 for causing the ram 40 to return to an upper position as shown in FIGS. 1 and 2 of the drawings. The elastic members 42 may be comprised of various elastic materials such as but not limited to elastic cords. The elastic members 42 are preferably in a tensioned state when the ram 40 is in the upper position shown in FIG. 1 of the drawings.

D. Flywheels

A pair of support brackets 52 are pivotally attached to the housing 20 for supporting the flywheels 50. The pivot point for each of the support brackets 52 is preferably in an outer side portion of the housing 20 as shown in FIGS. 1 and 2 of the drawings. The actuator 60 is preferably connected to an inner portion of the support brackets 52 by the connecting members 56 as shown in FIGS. 1 and 2 of the drawings.

The pair of flywheels 50 are rotatably attached to the support brackets 52 and are positioned on opposite sides of the ram 40 for engaging the ram 40 in a frictional manner as shown in FIGS. 1 through 6 of the drawings. The flywheels 50 each have an outer perimeter that engages the ram 40. The outer perimeter of the flywheels 50 preferably has a gripping material and the ram 40 preferably has a similar gripping material for increasing the frictional engagement of the flywheels 50 with the ram 40 (such as but not limited to brake pad materials).

One or more motors 54 are mechanically connected to the flywheels 50 by a connecting member 56 for rotating the flywheels 50 as shown in FIGS. 1 and 2 of the drawings. The motors 54 are preferably comprised of electric motors 54 (AC or DC), however various other types of motors 54 may be utilized with the present invention.

The flywheels 50 each preferably have an opposite rotation from one another as further shown in FIGS. 1 and 2 of the drawings. The connecting member 56 may be comprised of an endless structure such as a belt, cable or chain.

The actuator 60 is attached within the housing 20 and is mechanically connected to the support brackets 52 for controlling a position of the flywheels 50. The actuator 60 may be comprised of any conventional actuator device capable of moving the support brackets 52. More particularly, the actuator 60 is connected to the inner portion of the support brackets 52 for selectively positioning the perimeter edge of the flywheels 50 in engagement with an outer surface of the ram 40 as shown in FIG. 2 of the drawings.

A pair of linkage members 64 are connected between the actuator 60 and the support brackets 52 as bests shown in FIGS. 1 and 2 of the drawings. The linkage members 64 are connected to a connector member 62 movably extendible from the actuator 60 as further shown in FIGS. 1 and 2 of the drawings.

The actuator 60 preferably closes the flywheels 50 upon the ram 40 when the ram 40 is in or near the upper position as shown in FIGS. 1 and 2 of the drawings. The actuator 60 preferably opens the flywheels 50 when the ram 40 is in or near the lower position.

U.S. Pat. No. 4,747,455 teaches a combination flywheel and ram 40 system that is suitable for usage within the present invention. The applicant hereby incorporates by reference U.S. Pat. No. 4,747,455.

E. Sensors

The upper sensor 68 and the lower sensor 69 are positioned within the housing 20 for determining a position of the ram 40 as shown in FIGS. 1 through 6 of the drawings. The upper sensor 68 and the lower sensor 69 may be comprised of a light sensor structure or other sensing device capable of determining the position of the ram 40 within the guide channel 32.

F. Control Unit

The control unit 66 is in communication with the actuator 60, the sensors 68, 69 and the motors 54. The control unit 66 is also electrically connectable to a power source 14 such as a conventional AC wall power source 14. The power source 14 may also be comprised of a portable device such as a battery which provides increased mobility of the present invention.

G. Engaging Plate

Figure 3:
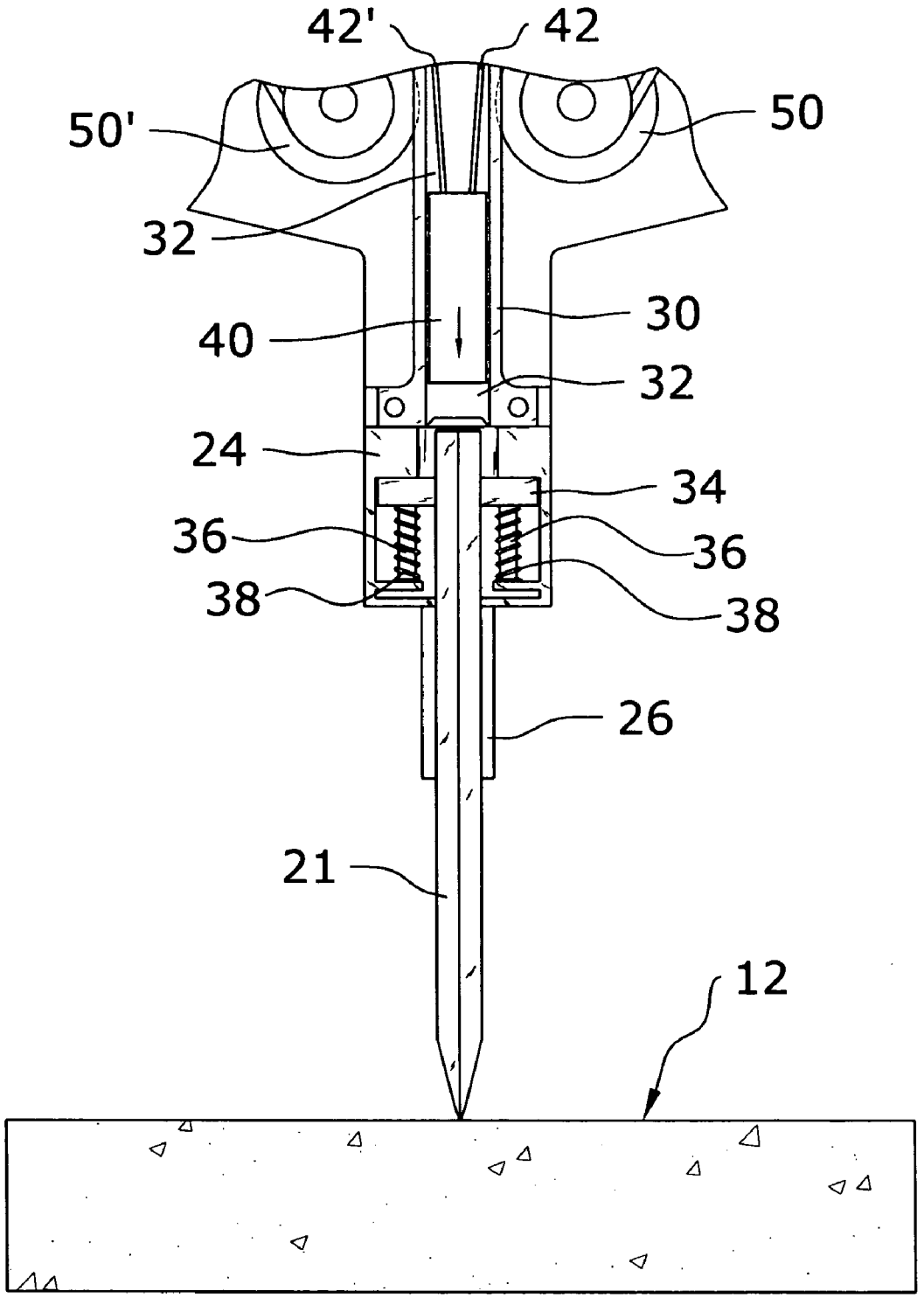
FIG. 3 is a side view of the present invention with the ram extending downwardly within the guide channel of the guide member.
Figure 4:
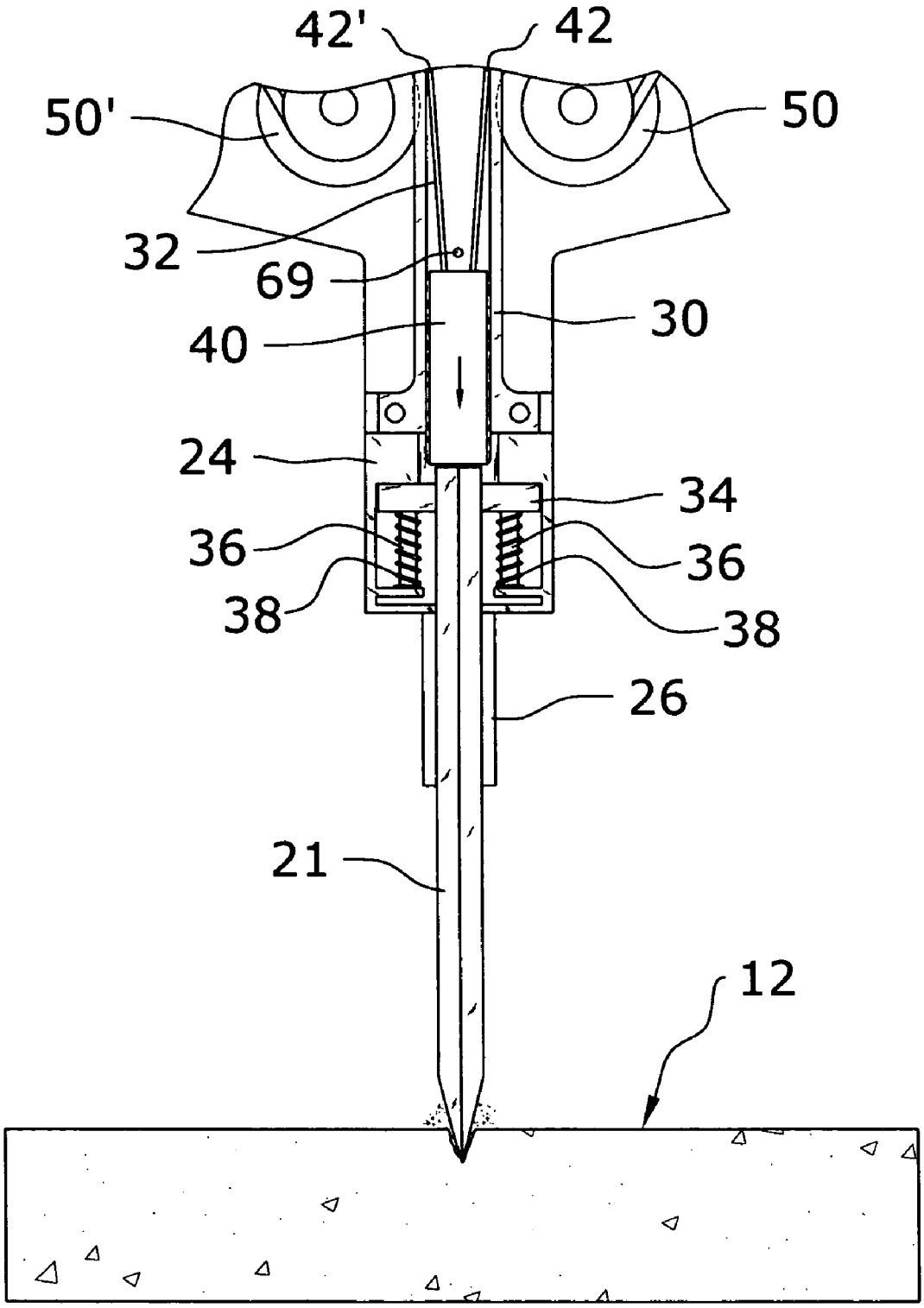
FIG. 4 is a side view of the ram engaging the upper end of the chisel.
Figure 5:
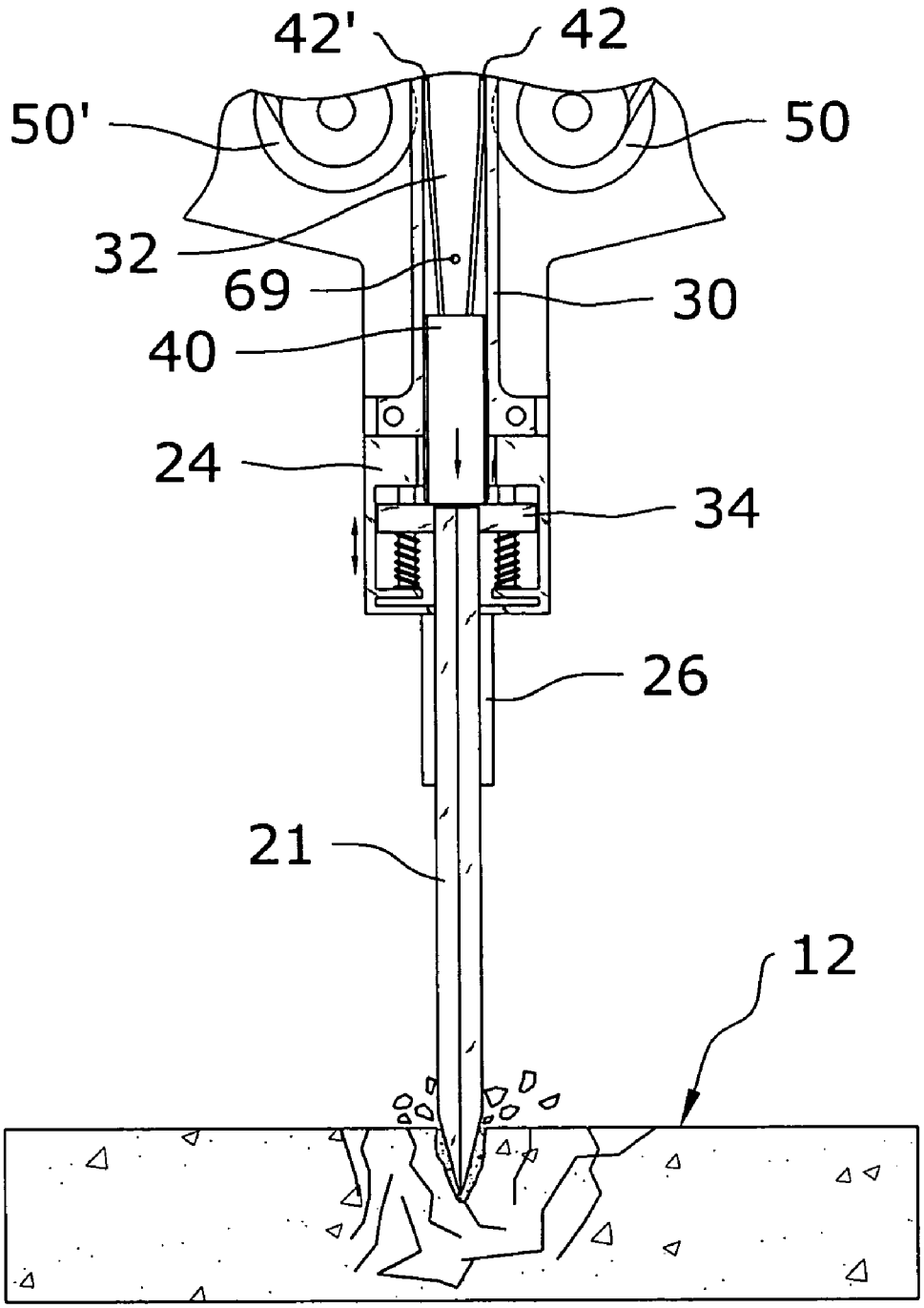
FIG. 5 is a side view of the ram forcing the chisel downwardly into the concrete.

The engaging plate 34 is movably supported by a plurality of compression springs 38 within a lower portion 24 of the housing 20 as shown in FIGS. 1 through 6. The engaging plate 34 receives the downward impact of the ram 40 when driving the chisel 21 downwardly and when the ram 40 extends into a lower position as best illustrated in FIG. 5 of the drawings. The engaging plate 34 helps absorb the impact of the ram 40 when the ram 40 is in the lower position to help reduce the vibration to the operator.

The engaging plate 34 has a central aperture for allowing a main portion of the chisel 21 to freely pass through. The central aperture has a size smaller than a main shaft portion of the ram 40 for allowing the chisel 21 to pass freely through the engaging plate 34 except for a head of the chisel 21.

The engaging plate 34 is preferably movable along an axis concentric with the ram 40 as shown in FIG. 5 of the drawings. A plurality of guide posts 36 are attached to the lower portion 24 of the housing 20 for slidably supporting the engaging plate 34 as further shown in FIGS. 1 through 6 of the drawings. The engaging plate 34 is preferably movable along an axis concentric with the ram 40 as shown in FIG. 5 of the drawings.

H. Recoil Absorber

The recoil absorber 70 includes a recoil spring 72 and is attached within the upper portion 28 of the housing 20. The recoil absorber 70 is movably attached to the upper portion 28 of the housing 20 for absorbing the recoil of the ram 40 when the ram 40 returns to an upper position. The end of the recoil absorber 70 is preferably a flanged structure and may be comprised of a resilient material such as but not limited rubber. The recoil absorber 70 is preferably concentric with a longitudinal axis of the guide channel 32.

I. Operation of Invention

Figure 6:
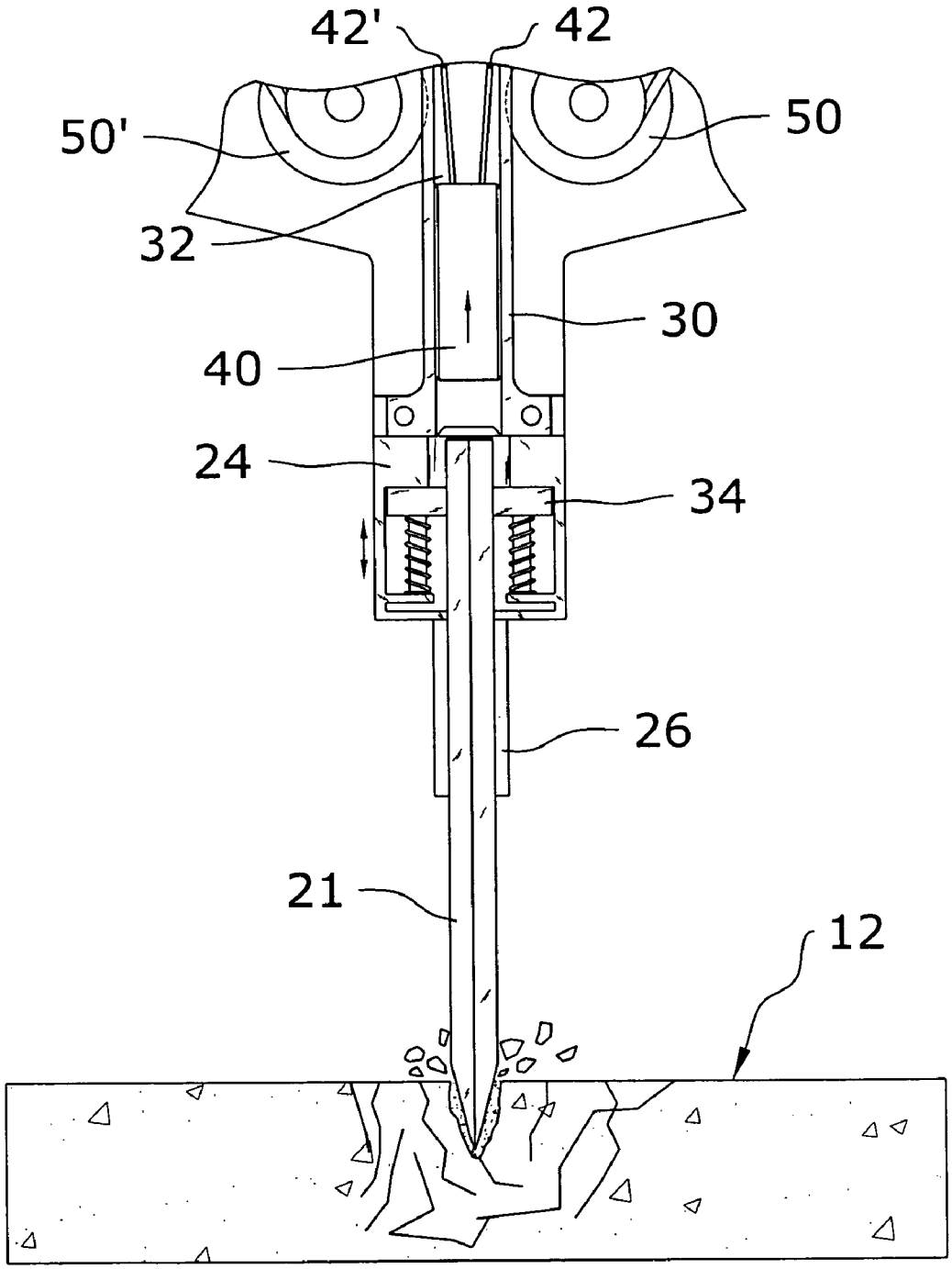
FIG. 6 is a side view of the ram returning back to the upper position.
Figure 7:
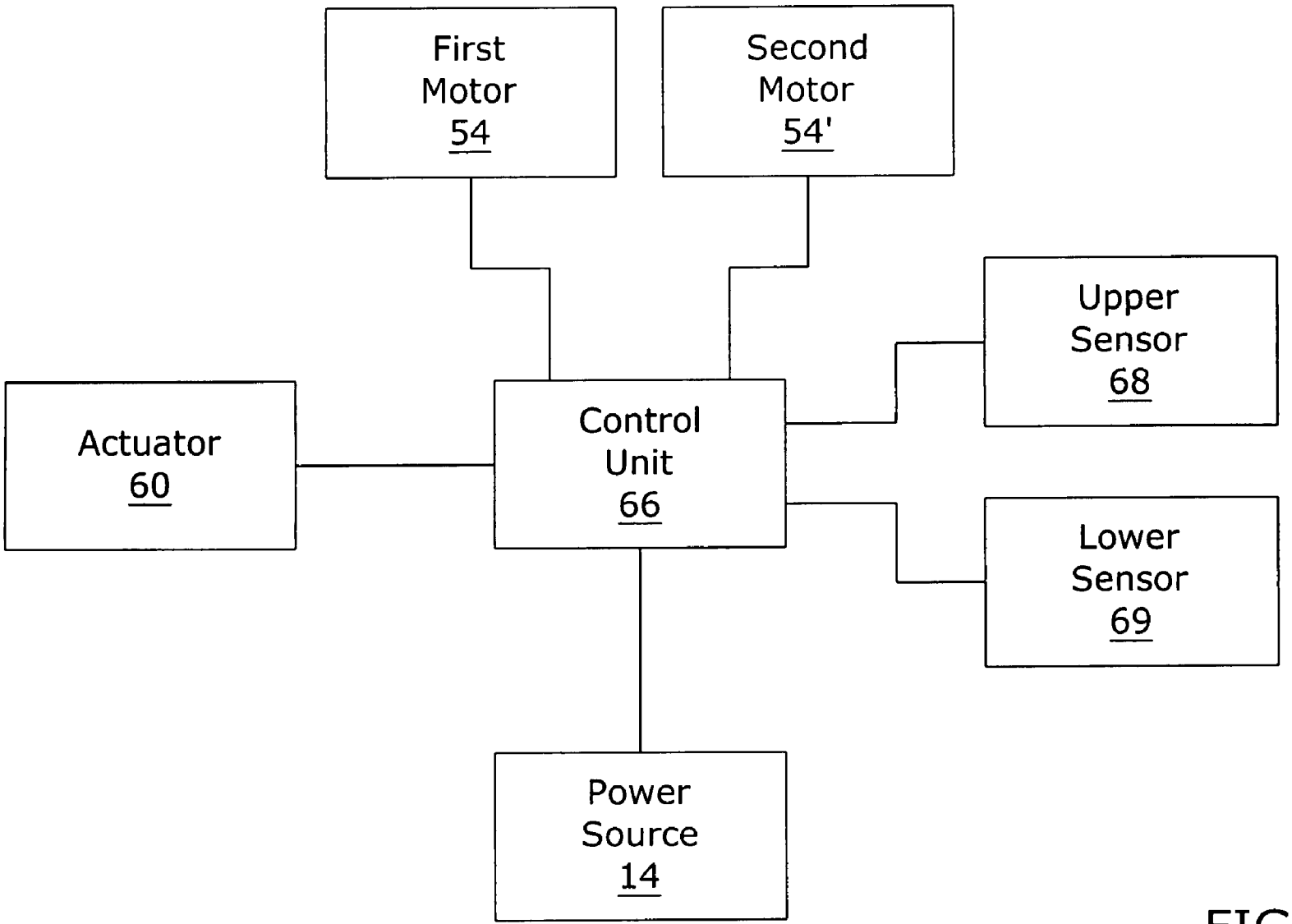
FIG. 7 is a block diagram of the present invention.

In operation, the user activates a control switch which communicates to the control unit 66 the same. The control unit 66 activates the motors 54 which in turn rotate the flywheels 50 in a counter-rotational manner as shown in FIG. 1 of the drawings. When the upper sensor 68 detects that the ram 40 is in the upper position, the control unit 66 then activates the actuator 60 which pulls the inner portions of the support brackets 52 upwardly. As the support brackets 52 are pulled upwardly, the outer perimeter of the flywheels 50 engage the gripping surface of the ram 40 as shown in FIG. 2 of the drawings. The rotational movement of the flywheels 50 is transferred to the ram 40 thereby forcing the ram 40 downwardly within the guide channel 32 of the guide member 30 as shown in FIGS. 2 and 3 of the drawings. As the ram 40 passes by the lower sensor 69, the control unit 66 activates the actuator 60 to open the flywheels 50 from the ram 40 to allow the ramp to return to the upper position after impacting the chisel 21. The ram 40 continues the downward path within the guide channel 32 until it impacts the upper head of the chisel 21 as shown in FIGS. 3 through 5 of the drawings. The momentum of the ram 40 is transferred to the chisel 21 wherein the lower end of the chisel 21 penetrates a hard surface such as concrete 12. After the transfer of the momentum of the ram 40 to the chisel 21, the elastic members 42 draw the ram 40 back to the upper position as shown in FIGS. 6 and 1 of the drawings. The above process is thereafter repeated until the operator terminates the operation of the invention.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A jackhammer system, comprising:

a housing;

a chisel movably positioned within a lower neck of said housing;

a pair of support brackets pivotally attached to said housing;

a pair of flywheels rotatably attached to said support brackets;

at least one motor mechanically connected to said flywheels for rotating said flywheels, wherein said flywheels each have an opposite rotation from one another;

a ram slidably positioned within a guide channel of a guide member, wherein said ram is positionable between and engageable by said flywheels to engage said chisel;

a plurality of elastic members attached to said ram;

at least one actuator connected to said support brackets for selectively positioning a perimeter edge of said flywheels in engagement with an outer surface of said ram;

at least one sensor within said housing for determining a position of said ram;

a control unit in communication with said at least one actuator, said at least one sensor and said motors;

an engaging plate movably supported by a plurality of compression springs within a lower portion of said housing that receives the downwardly impact of said ram when driving said chisel downwardly and when said ram extends into a lower position, wherein said engaging plate has a central aperture for allowing said chisel to freely pass through and wherein said central aperture has a size smaller than a main shaft portion of said ram; and a plurality of guide posts for slidably supporting said engaging plate.

2. The jackhammer system of claim 1, wherein said at least one sensor is comprised of an upper sensor and a lower sensor to determine a position of said ram within said guide channel.

3. The jackhammer system of claim 1, including a recoil absorber having a recoil spring movably attached to an upper portion of said housing for absorbing a recoil of said ram when said ram returns to an upper position.

4. The jackhammer system of claim 1, wherein said engaging plate is movable along an axis concentric with said ram.

5. The jackhammer system of claim 1, wherein said flywheels each have an outer perimeter that engages said ram.

6. The jackhammer system of claim 1, wherein said flywheels are positioned on opposite sides of said ram.

7. The jackhammer system of claim 1, wherein said control unit is electrically connectable to a power source.

8. The jackhammer system of claim 7, wherein said power source is a battery.

9. The jackhammer system of claim 1, including a pair of linkage members connected between said actuator and said support brackets.

10. The jackhammer system of claim 9, wherein said linkage members are connected to a connector member movably extendible from said actuator.

11. The jackhammer system of claim 1, wherein said actuator closes said flywheels upon said ram when said ram is in said upper position and wherein said actuator opens said flywheels when said ram is in said lower position.

12. The jackhammer system of claim 1, wherein a pivot point for each of said support brackets is in an outer side portion of said housing and wherein said actuator is connected to an inner portion of said support brackets.

13. A jackhammer system, comprising:

a housing;

a chisel movably positioned within a lower neck of said housing;

a ram slidably positioned within a guide channel of a guide member;

a pair of support brackets pivotally attached to said housing;

a pair of flywheels rotatably attached to said support brackets and positioned on opposite sides of said ram for engaging said ram in a frictional manner, wherein said flywheels each have an outer perimeter that engages said ram;

at least one motor mechanically connected to said flywheels for rotating said flywheels, wherein said flywheels each have an opposite rotation from one another;

a plurality of elastic members attached to said ram;

at least one actuator connected to said support brackets for selectively positioning a perimeter edge of said flywheels in engagement with an outer surface of said ram, wherein said actuator closes said flywheels upon said ram when said ram is in said upper position and wherein said actuator opens said flywheels when said ram is in said lower position;

an upper sensor and a lower sensor within said housing for determining a position of said ram;

a control unit in communication with said at least one actuator, said at least one sensor and said motors;

an engaging plate movably supported by a plurality of compression springs within a lower portion of said housing that receives the downwardly impact of said ram when driving said chisel downwardly and when said ram extends into a lower position, wherein said engaging plate has a central aperture for allowing said chisel to freely pass through and wherein said central aperture has a size smaller than a main shaft portion of said ram, a plurality of guide posts for slidably supporting said engaging plate, wherein said engaging plate is movable along an axis concentric with said ram; and a recoil absorber having a recoil spring movably attached to an upper portion of said housing for absorbing a recoil of said ram when said ram returns to an upper position.

14. The jackhammer system of claim 13, wherein said control unit is electrically connectable to a power source.

15. The jackhammer system of claim 14, wherein said power source is a battery.

16. The jackhammer system of claim 13, including a pair of linkage members connected between said actuator and said support brackets.

17. The jackhammer system of claim 16, wherein said linkage members are connected to a connector member movably extendible from said actuator.

18. The jackhammer system of claim 13, wherein a pivot point for each of said support brackets is in an outer side portion of said housing and wherein said actuator is connected to an inner portion of said support brackets.

* * * * *